US010051375B2

(12) United States Patent
Cai et al.

(10) Patent No.: US 10,051,375 B2
(45) **Date of Patent: *Aug. 14, 2018**

(54) SPEAKER BOX

(71) Applicant: AAC Technologies Pte. Ltd., Singapore OT (SG)

(72) Inventors: Bin Cai, Shenzhen (CN); Yunxia Xu, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

This patent is subject to a terminal disclaimer.

(21) Appl. No.: 14/984,584

(22) Filed: Dec. 30, 2015

(65) Prior Publication Data

US 2016/0227313 A1 Aug. 4, 2016

(30) Foreign Application Priority Data

Feb. 2, 2015 (CN) ..... 2015 2 0073852 U

(51) Int. Cl.

| | |
|---|---|
| ***H04R 7/18*** | (2006.01) |
| ***H04R 1/28*** | (2006.01) |
| ***H04R 1/02*** | (2006.01) |
| ***H04R 7/12*** | (2006.01) |

(52) U.S. Cl.

CPC ..... *H04R 7/18* (2013.01); *H04R 1/021* (2013.01); *H04R 1/2884* (2013.01); *H04R 7/127* (2013.01); *H04R 1/025* (2013.01); *H04R 1/2888* (2013.01); *H04R 2499/11* (2013.01)

(58) Field of Classification Search

CPC ..... H04R 1/021; H04R 1/025; H04R 1/2888; H04R 7/04; H04R 7/06; H04R 7/08; H04R 7/10; H04R 7/20; H04R 2207/00; H04R 1/323; H04R 7/127; H04R 2499/11

See application file for complete search history.

(56) References Cited

U.S. PATENT DOCUMENTS

| | | | | |
|---|---|---|---|---|
| 2005/0157900 | A1* | 7/2005 | Litovsky | H04R 7/20 381/349 |
| 2012/0281869 | A1* | 11/2012 | Takewa | H04R 1/345 381/398 |
| 2014/0119592 | A1* | 5/2014 | Choi | H04R 9/025 381/412 |
| 2016/0227304 | A1* | 8/2016 | Xu | H04R 1/021 |
| 2016/0227314 | A1* | 8/2016 | Cai | H04R 1/2888 |

* cited by examiner

*Primary Examiner* — Joshua Kaufman
(74) *Attorney, Agent, or Firm* — Na Xu; IPro, PLLC

(57) ABSTRACT

A speaker box includes a housing which has a receiving space and a side wall having a sound hole, and a sound generator received in the receiving space and including a diaphragm including a dome and a periphery connected to the dome. The periphery includes a near-end which is near the sounding hole and a far-end which is farther the sounding hole. A compliance of the near-end is less than a compliance of the far-end.

7 Claims, 2 Drawing Sheets

SPEAKER BOX

FIELD OF THE INVENTION

The present invention relates to speakers for converting electrical signals into sound waves, and more particularly related to a vibration balanced speaker box.

DESCRIPTION OF RELATED ART

In the mobile Internet era, number of smart mobile devices is on the rise. Among all kinds of mobile devices, mobile phone is undoubtedly the most common and most portable mobile terminal device. Mobile phone's functions are very diversified at present. One of them is high-quality music feature. The speaker of the mobile phone is the one of the prerequisite conditions to realize the high quality music feature. In the mobile phones on the market at present, the miniature electromagnetic speaker is commonly used for realizing music playing function.

Normally, the speaker includes a frame as the housing, a magnet system fixed in the frame and a vibration system which interacts with the magnetic system and vibrates. The magnetic system typically includes a yoke, a magnet fixed at a center of the yoke and a magnetic gap formed between the yoke and the magnet. The vibration system typically includes a voice coil extending into the magnetic gap and a diaphragm connected to the voice coil. When the voice coil receives the electrical signals containing audio signals, it interacts with the magnetic field of the magnet system, and generates Ampere force. Stressed under the Ampere force, the voice coil realizes reciprocating vibration, thus resulting in the vibration of the diaphragm, and producing acoustic radiation. Along with the development of intellectualized mobile phones, the media content on mobile phone is increased more and more. The user's requirement on sound quality of media is also increased. The user hopes the sound generator in the mobile phone can provide better low frequency response. This requires the sound generator to have a relatively larger back cavity. This leads to the structure that the sound generator is packed in the cavity. This structure is generally called as speaker box.

The speaker box usually requires a sounding hole to transmit the sound generated from the sound generator element to the outside. Generally, the position of the sounding hole is biased in the speaker box relative to the sound generator element, which is that the position of the sounding hole is biased relative to the center of the sound generator element. In this way, the vibration system of the sound generator element is divided into the near-end which is near the sounding hole, and the far-end which is farther the sounding hole. When the vibration system vibrates, the air around the near-end of the vibration system is relatively easier to pass through the sounding hole; while the air around the far-end is comparatively more difficult to pass through the sounding hole. It can be simply understood that the near-end near the sounding hole is easier to vibrate; while the far-end is relatively difficult to vibrate. This leads to an imbalance vibration of the vibration system between the near-end and the far-end, and leads to a series of problems, such as infidelity.

Therefore, it is necessary to provide an improved speaker box to solve the problems mentioned above.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENT

The present invention will hereinafter be described in detail with reference to an exemplary embodiment. To make the technical problems to be solved, technical solutions and beneficial effects of present disclosure more apparent, the present disclosure is described in further detail together with the figures and the embodiment. It should be understood the specific embodiment described hereby is only to explain this disclosure, not intended to limit this disclosure.

Figure 1:
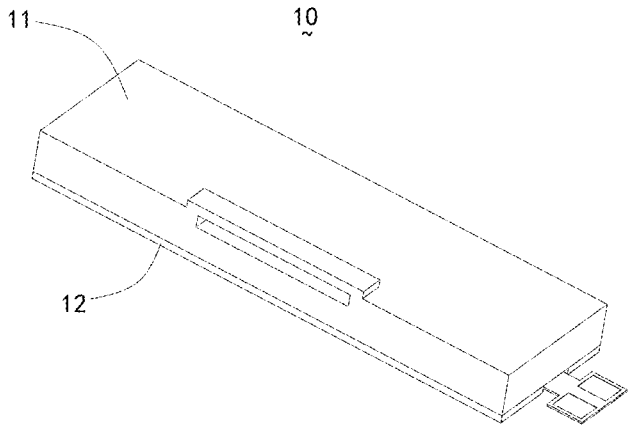
FIG. 1 is an isometric view of a speaker box in accordance with an exemplary embodiment of the present disclosure.
Figure 2:
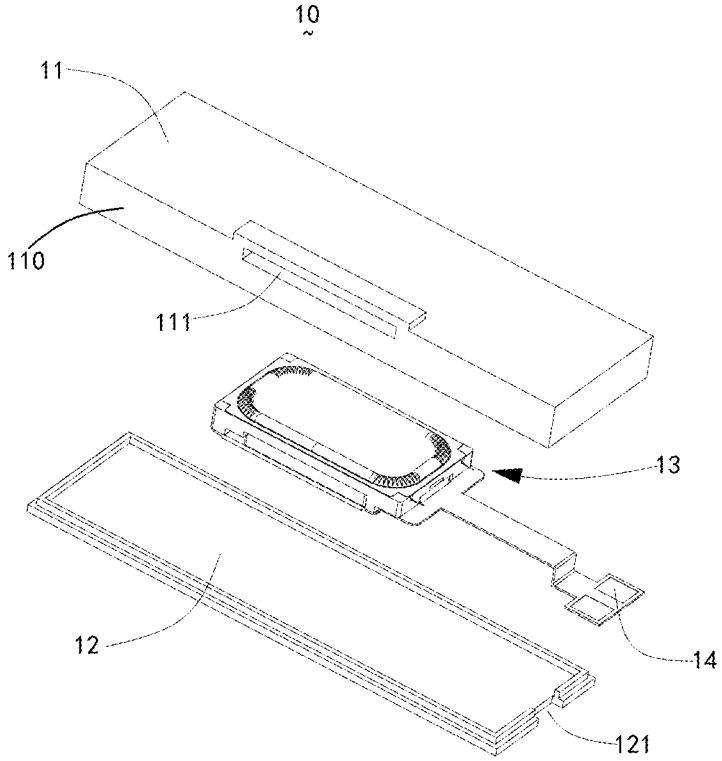
FIG. 2 is an exploded schematic view of the speaker box in FIG. 1.
Figure 3:
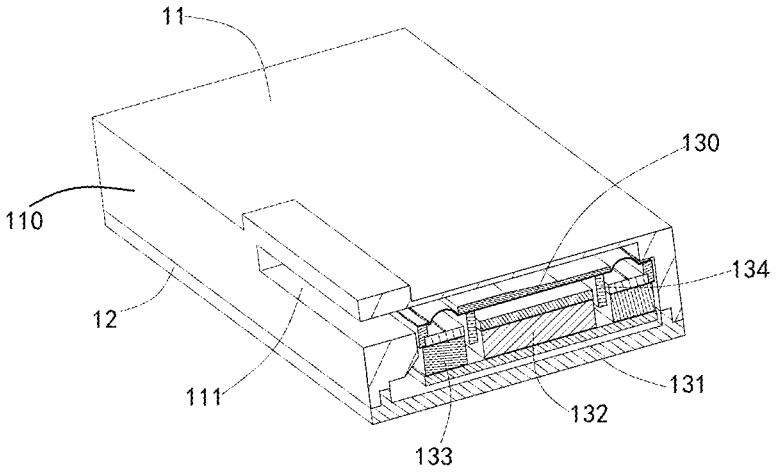
FIG. 3 is a cutting view of the speaker box in FIG. 1.
Figure 4:
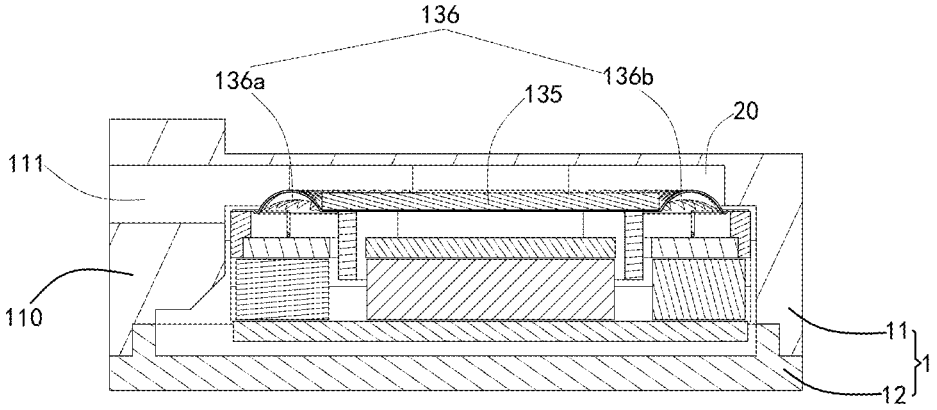
FIG. 4 is a cross-sectional view of the speaker box in FIG. 1.

As shown in FIGS. 1-4, a speaker box 10 disclosed in an exemplary embodiment of the present disclosure includes a housing 1 which has a receiving space 20 and a sound generator inside the housing 1. The housing 1 includes an upper housing 11 and a lower housing 12. The upper housing 11 and lower housing 12 form the receiving space 20. The upper housing 11 is provided with a side wall 110. The receiving space 20 on the side wall 110 is used to export the sound emitted by the sound generator 13 to the sounding hole 111 outside the speaker box 10. The sound generator 13 is connected to an external circuit through a conductive element 14. In this embodiment, the conducting element 14 is a flexible circuit board. In order to facilitate the conducting element 14 to connect to the outside, the lower housing 12 is provided with a notch 121 at the position corresponding to the conducting element 14. The conducting element 14 is connected to the outside through the notch 121.

The sound generator 13 further comprises a magnetic system and a vibration system which is interactive to the magnetic system. The magnetic system includes a lower plate 131 fixed to a main magnet 132 at a central position of the lower plate 131, and a secondary magnet fixed to the lower plate 131 and kept a space to the main magnet 132. Thereby, a magnetic gap is accordingly formed between the main magnet 132 and secondary magnet 133. The vibration system includes a voice coil 134 suspended in the magnetic gap and a diaphragm 130 connected to the voice coil 134 for vibration sounding. The diaphragm 130 further includes a dome 135 located at a central position thereof and a periphery 136 surrounding and supporting the dome 135.

With the sounding hole 111 as a reference, the periphery 136 is defined that it includes a near-end **136*a* which is near the sounding hole 111, and a far-end 136*b* which is farther the sounding hole 111**.

As the resistance received by the far-end **135*b* during vibration is greater than the resistance of the near-end 135*a*, the vibration is imbalanced. The weight of the far-end 136*b* is set to be smaller than the weight of the near-end 136*a*. The compliance of the near-end 136*a* of the dome is less than the compliance of the far-end 136*b*. The acoustic resistance of the far-end 136*b* of the periphery 136 can be made smaller, so as to balance the vibration of the diaphragm 130 and reduce infidelity. Optionally, the weight at the periphery 136 is increased gradually from the far-end 136***b* to the near-end 136*a*.

In addition, a thickness of the near-end 136*a* is set to be greater than a thickness of the far-end 136*b*, and the thickness can be increased gradually from the far-end 136*b* to the near-end 136*a*. The near-end 136*a* and the far-end 136*b* can also be made of different materials. The material density of the near-end 136*a* can be bigger than the material density of the far-end 136*b*.

The present disclosure discloses a speaker box, by setting the different property or different material of the near-end and far-end of the periphery, such as thickness or material, to increase the compliance of the far-end, reduce acoustic impedance, balance diaphragm vibration and reduce infidelity.

It is to be understood, however, that even though numerous characteristics and advantages of the present embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A speaker box, comprising:

a housing which has a receiving space and a side wall having a sound hole;

a sound generator received in the receiving space and comprising a diaphragm including a dome in a planar shape and a periphery having a curvature connected to the dome, the periphery surrounding and supporting the dome, the periphery including a near-end which is near the sounding hole and a far-end which is farther from the sounding hole wherein the near-end is opposite to the far-end, and a compliance of the near-end is less than a compliance of the far-end.

2. The speaker box as described in claim 1, wherein the near-end and far-end are made of different materials, and the density of the near-end material is greater than the density of far-end material.

3. The speaker box as described in claim 1, wherein a thickness of the near-end is greater than a thickness of the far-end.

4. The speaker box as described in claim 3, wherein the thickness is increased gradually from the far-end to the near-end.

5. The speaker box as described in claim 1, wherein the weight of the near-end is greater than the weight of the far-end.

6. The speaker box as described in claim 5, wherein the weight is increased gradually from the far-end to the near-end.

7. The speaker box as described in claim 1, wherein the housing includes an upper housing and a lower housing; the speaker box further comprises a conducting element connected to the sound generator; the lower housing is provided with a notch at the position corresponding to the conducting element; the conducting element is connected to the outside through the notch.

* * * * *